United States Patent [19]

Goedecke et al.

[11] 4,080,521

[45] Mar. 21, 1978

[54] QUENCHING CONTACT ARRANGEMENT FOR A COMPRESSED-GAS CIRCUIT BREAKER

[75] Inventors: Heiko Goedecke; Klaus-Peter Rolff; Karl Zückler; Horst Kopplin; Günter Richter; Peter Huhse, all of Berlin, Germany

[73] Assignee: Siemens Aktiengesellschaft, Munich, Germany

[21] Appl. No.: 577,919

[22] Filed: May 15, 1975

[30] Foreign Application Priority Data

Aug. 5, 1974 Germany ..... 2438017

[51] Int. Cl.[2] ..... H01H 9/32

[52] U.S. Cl. ..... 200/148 R; 200/148 G

[58] Field of Search ..... 200/148

[56] References Cited

U.S. PATENT DOCUMENTS

| | | | |
|---|---|---|---|
| 2,233,180 | 2/1941 | Petermichl | 200/148 G |
| 3,855,437 | 12/1974 | Geodecke et al. | 200/148 R |

*Primary Examiner*—Gerald P. Tolin

*Attorney, Agent, or Firm*—Kenyon & Kenyon, Reilly, Carr & Chapin

[57] ABSTRACT

The invention is directed to a quenching and contact arrangement for a compressed-gas circuit breaker. The arrangement includes a tubular contact piece and a contact piece axially arranged therewith. An arc is drawn between both contact pieces when the circuit is interrupted under load, the arc then being blasted by a stream of compressed-gas. A turbulence grid is arranged in the flow path of the stream. The turbulence grid is configured in the form of a tube of insulating material with perforations in the cylinder surface thereof which directly encloses the arcing space in the course of the circuit-breaking motion.

20 Claims, 4 Drawing Figures

QUENCHING CONTACT ARRANGEMENT FOR A COMPRESSED-GAS CIRCUIT BREAKER

BACKGROUND OF THE INVENTION

The invention relates to a quenching and contact arrangement for a compressed-gas circuit breaker which includes a tubular contact and a contact axially arranged with respect thereto between which an arc blasted by a compressed-gas stream is drawn when breaking the circuit under load. A turbulence grid is disposed in the path of the compressed-gas stream.

The term turbulence grid is here understood to be means dividing the compressed-gas stream and generating several mutually independent gas jets. In Deutsche Auslegeschrift No. 1,064,592 there is disclosed a compressed-gas circuit breaker with a closed quenching chamber wherein eddy formations must be expected in the course of the gas flow to the switching chamber because of structural aspects such as elbows; these formations may cause losses in the quenching performance. To eliminate such eddy formations, means to divide the gas flow, that is a turbulence grid, is provided which is configured in the form of a perforated disc. The holes in the perforated disc are disposed rotation-symmetrically. The chamber accommodating the perforated disc and guiding the compressed-gas is of such conical configuration that its cross-section increases gradually in the direction towards the perforated disc. The compressed-gas stream is divided into several mutually independent streams by means of the perforated disc. This destroys eddies originating in the stream and equalizes nonuniformities.

It is an object of the invention to stabilize the arc drawn between the contacts without thereby increasing the compressed-gas consumption in compressed-gas circuits of the type described above.

SUMMARY OF THE INVENTION

According to the invention, the above object is achieved by configuring the turbulence grid in the form of a tube of insulating material with a perforated cylinder surface which directly encloses the arcing chamber in the course of the circuit breaking motion. Accordingly, the turbulence grid of the quenching and contact arrangement of the invention is a wall enabling the arcing chamber and the compressed-gas chamber to be separated from each other. This wall is permeable for the compressed-gas, but not for the burning arc.

The compressed-gas circuit breaker in which the quenching and contact arrangement according to the invention is utilized is in the form of a blast-piston type of circuit breaker. The arrangement includes gas blast means having a piston and a cylinder to generate the compressed-gas flow. The tube of insulating material is coupled to the movable part of the blasting device and is pulled across at least one of the contact pieces.

Basically, the switching arc in blast-piston circuit breakers is subjected to an essentially laminar inflow. It is only in the outflow area through the one tubular contact piece that the turbulence developing along the nozzle walls reaches the nozzle axis. Due to the installation of the turbulence grid in the form of a tube of insulating material with a perforated cylinder surface, the nozzle inlet area and the pressurized area are also supplied with turbulent flow. Accordingly, the entire arc column is cooled turbulently, resulting in a faster dielectric recovery.

The invention makes it possible to utilize the better heat conductivity of a turbulently flowing gas versus a laminar gas flow for the entire arc area. The turbulence grid directly enclosing the arcing chamber in the course of the circuit breaking motion causes the arc to be cooled intensively by turbulence.

In one advantageous embodiment of the quenching and contact arrangement according to the invention, the contact pieces are fixed and bridged in the contact-making position by an electrically conducting, movable bridging contact piece coupled to the movable part of the blasting device. The tube of insulating material may be rigidly joined to the free face of the bridging contact piece and form an electric insulation for a burn-off, resistant sliding contact ring mounted to the face of the bridging contact piece and establishing an electrically conducting connection with the other contact piece as it slides off of the first fixed contact piece.

It is particularly advantageous if the tube of insulating material is rigidly joined to the cylinder which is movable relative to the fixed piston of the blasting device, it being preferred if the tube of insulating material closely surrounds the slide-off contact piece at its free end.

The cross-sectional area of the insulating tube which is effective for the passage of the compressed-gas may be about half the cross-sectional area of the tubular contact piece intended for the discharge of the arc gases. This affords a reduction of the gas throughput and, hence, also a reduction in the size of the drive mechanism and the force-transmitting insulating parts of the compressed-gas circuit breaker.

In compressed-gas circuit breakers, particularly in blast piston circuit breakers, the gas consumption and, therefore, the construction of the drive mechanism is determined to a large extent by the nozzle diameter of the contact pieces which are configured to be hollow for the discharge of the switching gases. In order to obtain a sufficiently high inflow velocity of the compressed-gas towards the arc, this nozzle diameter must have a certain relationship to the mutual spacing of the two contact pieces which corresponds to the quenching distance and is determined by the dielectric stress of the compressed-gas circuit breaker.

By making the cross-sectional area of the insulating tube effective for the passage of compressed-gas about half the cross-sectional area of the tubular contact piece intended for the discharge of the arc gas, the quenching capacity can be increased with a smaller drive mechanism. In addition, it is possible to construct switching gaps for higher dielectric stresses without having to increase the diameter of the contact pieces of tubular configuration for the discharge of arc and switching gases.

If, as is provided in one embodiment of the invention, the tube of insulating material is made of polytetrafluoroethylene, additional quenching gas, very similar in its composition to the thermally decomposed sulfur hexafluoride, is produced by evaporation of the polytetrafluoroethylene at the very large currents to be interrupted and strong arcing associated therewith. Therefore, this embodiment is particularly well suited for a compressed-gas circuit breaker in which pressurized $SF_6$ is used as the quenching and insulating medium. The current-breaking capacity of the compressed-gas circuit breaker can thus be increased effectively. In one particularly advantageous embodiment of the quenching and contact arrangement according to the invention, the holes in the insulating tube forming the apertures for the passage of compressed-gas are evenly distributed over its cylinder surface in the circumferential direction. However, the holes may be unevenly distributed in the axial and/or azimuthal direction. It is also possible for the holes to have different diameters. Furthermore, an embodiment of the invention wherein the apertures on the side facing away from the arcing chamber have an expanded rim contour can be advantageous.

In order to provide for favorable flow conditions inside the arcing chamber, another embodiment of the invention provides that the holes in the insulating tube having the smallest and the largest diameters are disposed on diametrically opposed sides of each row of holes belonging to one radial plane, and that the rows of holes themselves are mutually staggered at an angle.

Although the invention is illustrated and described herein as a quenching contact arrangement for a compressed-gas circuit breaker, it is nevertheless not intended to be limited to the details shown, since various modifications may be made therein within the scope and the range of the claims. The invention, however, together with additional objects and advantages will be best understood from the following description and in connection with the accompanying drawings.

DESCRIPTION OF THE PREFERRED EMBODIMENTS OF THE INVENTION

Figure 1:
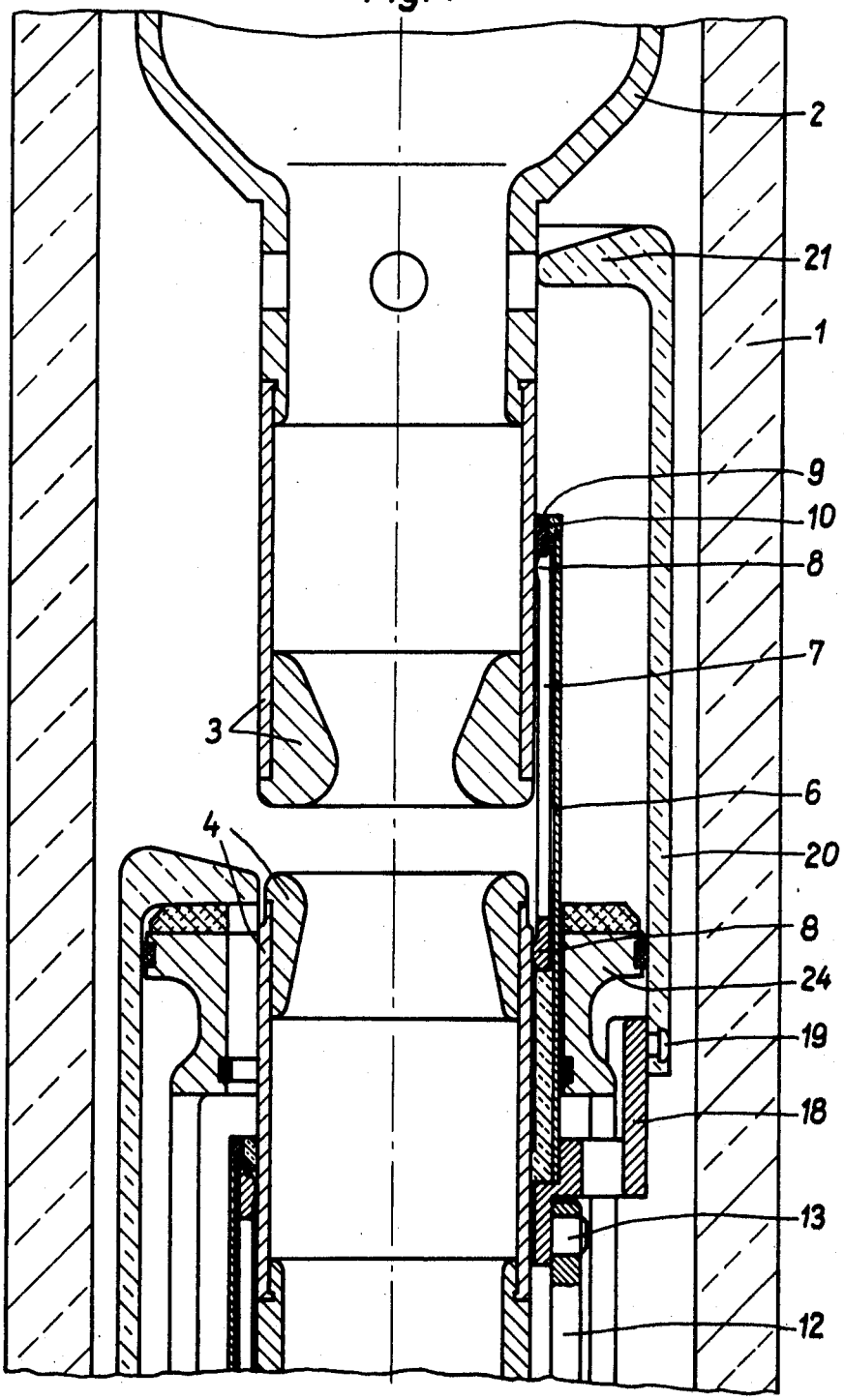
FIG. 1 is a schematic diagram, partially in longitudinal section, of an electric compressed-gas circuit breaker which can be equipped with the quenching and contact arrangement according to the invention. The breaker is shown in the open position to the left of the center line and in the closed position to the right of the center line.

The high-voltage circuit breaker shown in FIG. 1 can be, for example, 110 KV and can utilize sulfur hexafluoride as the quenching and insulating medium. Only those parts of the breaker are shown which are necessary to understand the invention. The circuit breaker at ground potential, the drive mechanism and the support insulators are not shown. The electric circuit breaker is constructed as a compressed-gas circuit breaker and includes a switching chamber 1 such as of porcelain to whose upper end a connector (not shown) is mounted. To this connector is attached a hollow metal part 2 which projects into the interior of the switching chamber 1 and supports a stationary contact piece 3. The contact piece 3 is faced by a stationary contact piece 4. Both contact pieces 3 and 4 are made hollow for the discharge of the switching gases and their mutually adjacent end-faces are nozzle-shaped.

In the closed position, the two stationary contact pieces 3 and 4 are connected by a bridging contact piece 6 which is of tubular configuration. Spring-loaded fingers 7 are mounted on the inside of the tubular piece 6 which press at their contact areas 8 with a predetermined contact pressure against the stationary contact pieces 3 and 4. The bridging contact piece 6 carries a sliding-contact ring of burn-off resistant, electrically conducting material with electrical insulation 10 interposed. The tubular bridging contact piece 6 is screwed into a coupling part 18 which is connected by means of fastening elements 19 to a tube 20 of insulating material which forms a blasting cylinder.

On its face 21, the blasting cylinder supports a nozzle part which encloses the stationary contact piece 3. The insulating tube 20 is made, for instance, from one piece, such as fiber-reinforced plastic. Together with the bridging contact piece 6, the insulating tube 20 is pulled across a stationary piston 24 during the circuit-breaking motion to make a flow of quenching medium available. The coupling part 18 is engaged by tie rods 12 which are movably mounted on a pin 13. Coupled to the tie rods 12 is a driving member (not shown) which moves the circuit breaker from the circuit-making position shown to the right of the center line into the open position shown to the left.

The switching chamber 1 is completely filled with sulfur hexafluoride pressurized to, say, 4 bar. During the circuit-breaking motion, the contact piece 6, together with the tube 20, moves downward from its up position. In so doing, the sulfur hexafluoride contained in the tube 20 is compressed because it cannot escape as yet at the start of the circuit-breaking motion. Only after the tube 20 has travelled about half the length of its stroke, the contact fingers 7 of the bridging contact piece 6 and the sliding contact ring 9 slide off the stationary contact piece 3 so that a cross-sectional outflow area is formed with the electrical separation. The sulfur hexafluoride, compressed up to this point, flows through this opening into the discharge nozzles formed by the two stationary contact pieces 3 and 4. In this process, the arc is commutated from the sliding contact ring 9 to the burn-off electrodes of arc-resisting material provided on the contact piece 4 and quenched because of the favorable flow conditions prevailing at the nozzles.

In the circuit-breaking position, the switching gap between the contact pieces 3 and 4 is clear. The prevailing field strength is only small because the contact pieces, as large-area electrodes, provide a uniform field.

Figure 2:
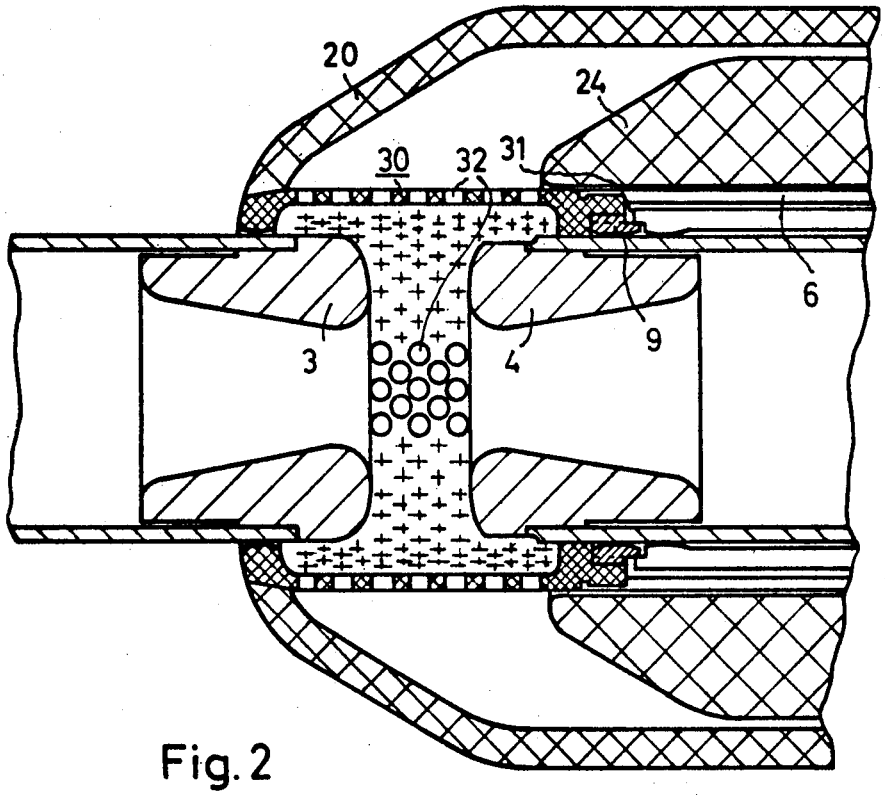
FIG. 2 is a schematic diagram of the quenching and contact arrangement according to the invention.

FIG. 2 shows that there is disposed in the path of the compressed-gas flow a turbulence grid 30 in the form of a tube of insulating material with a perforated cylinder surface. In the course of the circuit-breaking motion, this insulating tube 30 encloses the arcing space between the contact pieces 3 and 4. This results in a turbulent rather than a laminar compressed-gas flow in the inflow zone surrounding the arc. This brings with it an additional energy transport perpendicular to the flow lines so that the discharge of energy converted in the arc is multiplied as compared to a laminar flow. The residual arc column can, therefore, be cooled and destroyed more quickly. It is possible to influence in this manner also the arcing voltage which increases prior to the zero crossing of the alternating current because the arc resistance is then increased. The quenching conditions obtained with the turbulence grid arranged according to the invention are favorable.

The insulating tube 30 is coupled to the movable part 20 of the blasting device and pulled across at least one of the contact pieces 3. In the circuit-breaking position, the blasting cylinder 20 and the insulating tube 30 are in a position in which they enclose the contact piece 4 so that the switching gap between the contact pieces 3 and 4 remains free.

The turbulence grid 30 is configured in the form of a tube of insulating material and is rigidly joined to the free end-face 31 of the bridging contact piece 6. It forms part of the electrical insulation 10 for the burn-off resistant sliding contact ring 9 which is supported by the bridging contact piece 6 and establishes electrically conducting contact with the other contact piece 4 as it slides off the contact piece 3. The other side of the insulating tube 30 is rigidly joined to the piston 24 and the end-face of the turbulence grid 30 surrounds the slide-off contact piece 3 closely at its free end.

The cross-sectional area of the insulating tube 30 which is effective for the passage of compressed-gas may be about half the cross-sectional area of the tubular contact pieces 3 and 4 intended for the discharge of the arc gases. In this manner, a defined, throttled in-flow is obtained, through which the quenching capability can be increased while making the drive mechanism smaller at the same time. It has developed that a reduction of the effective hole cross-section in the insulating tube 30 makes possible a reduction of the blasting piston cross-section and of the drive, that is, a decrease of the driving force. The sharply bunched compressed-gas jets have high velocities also at smaller compression ratios and constrict the arc so that directing the arc into the interior of the hollow contact pieces 3 and 4 is facilitated.

The arrangement of the tubular turbulence grid 30 permits meeting the voltage and current requirements demanded of the compressed-gas circuit breaker largely independently of each other.

The turbulence grid 30 may consist of polytetrafluoroethylene. In that case, additional gas is liberated at very large currents due to evaporation of the insulating material. The liberated gas is very similar in its composition to the thermally decomposed sulfur hexafluoride and increases the current-breaking capacity of the circuit breaker.

The area heated by the arc is confined by the turbulence grid. This increases the pressure of the compressed-gas on the one hand and decreases the time required for the discharge of hot, undesirable switching gases on the other.

Figure 4:
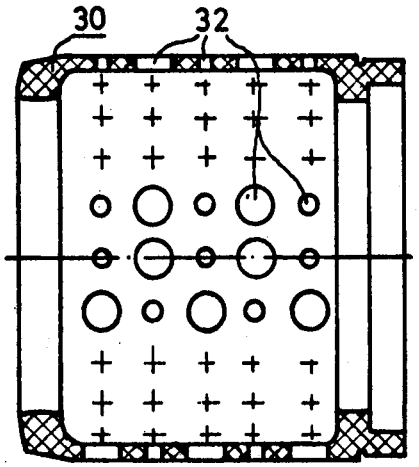
FIG. 4 illustrates a portion of a turbulence grid configured according to another subsidiary embodiment of the invention wherein the turbulence grid is provided with openings of different diameter.
Figure 3:
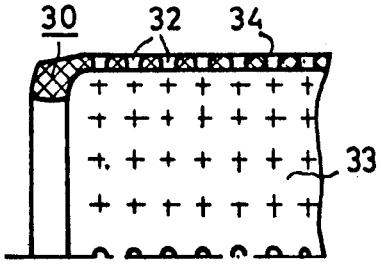
FIG. 3 shows in a detail a portion of the turbulence grid of the quenching and contact arrangement according to a subsidiary embodiment of the invention.

The holes 32 in the insulating tube 30 form apertures for the passage of compressed-gas and may be evenly distributed over its cylinder surface in the circumferential direction as shown in FIG. 2. It is also possible, however, for the holes to be unevenly distributed in the axial and/or azimuthal direction. It is of particular advantage if the holes 32 have different diameters as shown in FIG. 4. In the embodiment of the turbulence grid 30 shown in FIG. 4, the holes 32 having the smallest and the largest diameters are disposed on diametrically opposed sides of each row of holes belonging to one radial plane, the rows of holes themselves being mutually staggered at an angle. It is possible in this manner to accelerate the discharge of the gas volume normally remaining in the pressurized area. In the embodiment example shown in FIG. 4, the rows of holes are mutually staggered at a 180° angle. FIG. 3 shows that the holes 32 have an expanded rim contour on their side facing away from the arcing chamber between the contact pieces 3 and 4, which is advantageous for the build-up of the pressure in the blasting device on the one hand and leads to a desirable build-up of pressure in the arcing chamber on the other.

What is claimed is:

1. A quenching and contact arrangement for a compressed-gas circuit breaker comprising: a first contact piece; a tubular-like contact piece axially arranged with respect to said first contact piece; at least one of the contact pieces being movable with respect to the other one of the contact pieces between a first position whereat said contact pieces are in contact and a second position whereat said contact pieces are separated and a gap exists between an end face of said one contact piece and an end face of said other contact piece closest said end face of said one contact piece, an arc being drawn between said contact pieces and across said gap when said movable contact piece is in said second position under load; gas-blast means for developing a stream of gas for blasting the arc; and, turbulence grid means arranged in the flow path of said stream of gas so as to extend over the length of and directly surround said gap, said turbulence grid means being a tubular member made of insulating material and having a perforated tubular wall, a perforated portion of which extends along the length of and surrounds said gap.

2. The quenching and contact arrangement of claim 1, said gas-blast means comprising: a cylinder member for holding the gas therein; a piston member mounted in said cylinder member; and, actuator means for moving one of said members with respect to the other one of said members whereby said gas is compressed for developing said stream of gas; said turbulence grid means being coupled to said one member for pulling the same over the other one of the contact pieces.

3. The quenching and contact arrangement of claim 2, said one member being said cylinder member.

4. The quenching and contact arrangement of claim 3 comprising: a further contact piece adjacent the first contact piece, said first and further contact pieces being fixedly mounted and conjointly defining a space therebetween, the movable contact piece being a movable bridging piece movable between said first and second positions for electrically bridging said first and further contact pieces in said first position corresponding to the closed position of the breaker and for electrically separating said first and further contacts in said second position corresponding to the open position of the breaker, said bridging piece being coupled to said cylinder member.

5. The quenching and contact arrangement of claim 4, said bridging piece including: a support member having a free end-face; a burn-off resistant, slide-contact ring mounted on said support member for slideably engaging one of said fixedly mounted contact pieces as said bridging member is drawn away from said first contact piece in its movement to said second position, and means for connecting said slide-contact ring with the other one of said fixed contact pieces when said contact ring slides off of said first contact piece, said turbulence grid means being rigidly mounted to said support member at said free end-face thereof and being configured so as to constitute an insulating barrier between said slide-contact ring and said support member.

6. The quenching and contact arrangement of claim 3, said piston member being stationary, said first contact piece being fixedly mounted and said other contact piece being movable between said first position whereat said contacts are electrically joined and the breaker is closed and said second position whereat said contacts are electrically separated and the breaker is open, said tubular member constituting said turbulence grid means having respective longitudinal end portions, said tubular member being rigidly connected to said cylinder member at one of said end portions and being configured so as to tightly surround said first contact piece at said other end portion thereof.

7. The quenching and contact arrangement of claim 6, said first contact piece having a tubular configuration defining a passage for directing the arc gases formed in said gap away from said gap, said turbulence grid means having an effective cross-section for the passage therethrough of the pressurized gas, said effective cross-section being equal to the sum of the cross-sections of said perforations of said grid and being approximately one-half the cross-section of said passage of said first contact piece.

8. The quenching and contact arrangement of claim 1, said turbulence grid means being made of polytetrafluoroethylene.

9. The quenching and contact arrangement of claim 1, the perforation of said turbulence grid means being constituted by a plurality of openings formed therein for accommodating the passage of said pressurized gas therethrough.

10. The quenching and contact arrangement of claim 9, said openings being uniformly distributed over the surface of said tubular member constituting said turbulence grid.

11. The quenching and contact arrangement of claim 9, said openings being unevenly distributed in axial direction.

12. The quenching and contact arrangement of claim 9, said openings being unevenly distributed in azimuthal direction.

13. The quenching and contact arrangement of claim 9, said openings being unevenly distributed in both axial and azimuthal direction.

14. The quenching and contact arrangement of claim 9, said openings having different diameters.

15. The quenching and contact arrangement of claim 14, said openings being arranged in a plurality of rows one next to the other, each of said rows corresponding to a radial plane, a portion of the openings having small openings and the remainder having large openings and each row containing both small and large openings such that an opening of large diameter is diametrically opposite a small opening, each row being displaced from its adjacent row by a predetermined angle.

16. The quenching and contact arrangement of claim 9, said openings having a widened edge contour in the outer surface of said tubular member constituting said turbulence grid means.

17. The quenching and contact arrangement of claim 1 comprising: a further contact piece adjacent the first contact piece, said first and further contact pieces being fixedly mounted and conjointly defining a space therebetween, the movable contact piece being a movable bridging piece movable between said first and second positions for electrically bridging said first and further contact pieces in said first position corresponding to the closed position of the breaker and for electrically separating said first and further contacts in said second position corresponding to the open position of the breaker, said gas-blast means including a cylinder member for holding the gas therein; a piston member mounted in said cylinder member; and, actuator means for moving one of said members with respect to the other one of said members whereby said gas is compressed for developing said stream of gas, said turbulence grid means being coupled to said one member for pulling the same over at least one of said fixedly mounted contact pieces.

18. The quenching and contact arrangement of claim 17, said one member being said cylinder member.

19. The quenching and contact arrangement of claim 18, said bridging piece being coupled to said cylinder member.

20. The quenching and contact arrangement of claim 1, said first contact piece having a tubular configuration defining a passage for directing the arc gases formed in said gap away from said gap said turbulence grid means having an effective cross-section for the passage therethrough of the pressurized gas, said effective cross-section being equal to the sum of the cross-sections of said perforation of said grid and being approximately one-half the cross-section of said passage of said first contact piece.

* * * * *